US010049816B2

(12) United States Patent
Koyanagi et al.

(10) Patent No.: US 10,049,816 B2
(45) Date of Patent: Aug. 14, 2018

(54) SUPERCONDUCTING COIL PRODUCTION APPARATUS AND SUPERCONDUCTING COIL PRODUCTION METHOD

(71) Applicant: KABUSHIKI KAISHA TOSHIBA, Minato-ku (JP)

(72) Inventors: Kei Koyanagi, Yokohama (JP); Shigeki Takayama, Yokohama (JP); Hiroshi Miyazaki, Yokohama (JP); Kenji Tasaki, Nakano (JP); Taizo Tosaka, Yokohama (JP); Yusuke Ishii, Yokohama (JP)

(73) Assignee: Kabushiki Kaisha Toshiba, Minato-ku (JP)

( * ) Notice: Subject to any disclaimer, the term of this patent is extended or adjusted under 35 U.S.C. 154(b) by 382 days.

(21) Appl. No.: 14/767,659

(22) PCT Filed: Mar. 14, 2014

(86) PCT No.: PCT/JP2014/001471
§ 371 (c)(1),
(2) Date: Aug. 13, 2015

(87) PCT Pub. No.: WO2014/141722
PCT Pub. Date: Sep. 18, 2014

(65) Prior Publication Data

US 2016/0005538 A1 Jan. 7, 2016

(30) Foreign Application Priority Data

Mar. 15, 2013 (JP) ..... 2013-053263

(51) Int. Cl.
*H01F 6/06* (2006.01)
*H01F 41/04* (2006.01)
*H01F 41/071* (2016.01)

(52) U.S. Cl.
CPC ..... *H01F 41/048* (2013.01); *H01F 6/06* (2013.01); *H01F 2041/0711* (2016.01)

(58) Field of Classification Search
CPC ..... H01F 6/06; H01F 41/048; H01F 41/061; H01F 2041/0711
See application file for complete search history.

(56) References Cited

U.S. PATENT DOCUMENTS

2012/0286084 A1* 11/2012 Ko ..... B65H 75/14 242/430
2015/0380138 A1* 12/2015 Takayama ..... H01F 6/06 505/211

FOREIGN PATENT DOCUMENTS

JP 5 48195 6/1993
JP 8 306568 11/1996
(Continued)

OTHER PUBLICATIONS

International Search Report dated Jun. 24, 2014 in PCT/JP2014/001471 Filed Mar. 14, 2014.

*Primary Examiner* — Emmanuel M Marcelo
(74) *Attorney, Agent, or Firm* — Oblon, McClelland, Maier & Neustadt, L.L.P.

(57) ABSTRACT

According to an embodiment, a superconducting coil production device for producing a non-coplanar three-dimensional superconducting coil by winding a tape-like superconducting wire includes: a coil bobbin; a supply reel to supply the superconducting wire to the coil bobbin; and an adjustment driving unit to adjust a position of the supply reel relative to a wrapping point so that a position of the wrapping point of the coil bobbin around which the superconducting wire being supplied from the supply reel is wrapped becomes equal to a position of the supply reel in a rotational axis direction of the supply reel.

11 Claims, 9 Drawing Sheets

(56) References Cited

FOREIGN PATENT DOCUMENTS

| | | |
|---|---|---|
| JP | 2008 118006 | 5/2008 |
| JP | 2009 231442 | 10/2009 |
| JP | 2010 118457 | 5/2010 |

* cited by examiner

SUPERCONDUCTING COIL PRODUCTION APPARATUS AND SUPERCONDUCTING COIL PRODUCTION METHOD

TECHNICAL FIELD

Embodiments of the present invention relate to a superconducting coil production apparatus and a superconducting coil production method.

BACKGROUND ART

An yttrium-based (RE-based) thin film wire known as a second-generation high-temperature superconducting wire has a thin tape shape with a thickness of about 0.1 mm.

When the wire is turned into a coil, what is generally used is the "pancake winding" by which the wire is wound spirally by bending the wire in a flatwise direction (or out-of-plane direction of the wire). In this case, from the wire that is wound around a reel, the tip of the wire is pulled out and fixed to a coil bobbin. Then, the coil bobbin is rotated so that the wire is wound around the coil bobbin. In this manner, a pancake-winding coil is produced.

The wire supply reel and the coil bobbin are placed on the same plane. Therefore, the coil can be wound without causing any distortion of the wire in an edgewise direction (or width direction of the wire).

For a magnet used in accelerators, what is required is a "saddle type coil" in which the wire is wound along the surface of a cylindrical beam duct. Unlike the pancake coil in which the wire is wound in a planar manner, the coil is produced as a three-dimensional winding having a steric shape.

In the case of a such coil, if the coil bobbin is rotated around one axis as in the case of the pancake winding, the position where the coil is wound would change in the width direction of the wire. If the positions of the wire reel and coil bobbin change in the width direction of the wire during the coil winding, stress is generated in such a way as to deform the wire in the edgewise direction.

The RE-based thin film wire includes a base plate made of nickel alloy, and is therefore high in rigidity. Accordingly, the wire does not easily deform in the edgewise direction, and kinks could emerge locally. Therefore, there is a risk of causing a deterioration of superconducting properties.

As disclosed in Patent Documents 1 and 2, what has been known is the techniques regarding the superconducting coil winding method for winding a tape-like superconducting wire without adding distortion as much as possible. However, while the techniques are effective in a double pancake winding or a layer winding, the techniques do not support three-dimensional windings such as the saddle type.

PRIOR ART DOCUMENTS

Patent Documents

Patent document 1: Japanese Patent Application Laid-Open Publication No. 2008-118006

Patent document 2: Japanese Patent Application Laid-Open Publication No. 2009-231442

SUMMARY OF THE INVENTION

Problems to be Solved by the Invention

As described above, if a pancake-coil winding device that is designed to wind a wire in a planar manner is used to make a three-dimensional-winding coil with a tape-like superconducting wire, the position where the wire is wound around the coil would shift in the width direction of the wire.

Accordingly, the problem is that stress is generated in such a way as to deform the wire in the edgewise direction, leading to deterioration of the superconducting properties.

The object of embodiments of the present invention is to make it possible to wind a tape-like superconducting wire on a three-dimensional coil as well as to prevent a decrease in the superconducting properties.

Means for Solving the Problem

According to the present invention, there is provided a superconducting coil production apparatus that produces a non-coplanar three-dimensional superconducting coil by winding a tape-like superconducting wire, the apparatus comprising: a coil bobbin around which the superconducting wire is wound; a rotary driving unit to rotate the coil bobbin around a coil axis of the superconducting coil; a supply reel to supply the superconducting wire to the coil bobbin; and an adjustment driving unit to adjust a position of the supply reel relative to a wrapping point so that a position of the wrapping point of the coil bobbin around which the superconducting wire being supplied from the supply reel is wrapped is kept the same position as the position of the supply reel in a rotational axis direction of the supply reel.

According to the present invention, there is provided a superconducting coil production method for producing a non-coplanar three-dimensional superconducting coil by winding a tape-like superconducting wire, comprising: a rotating step of rotating the coil bobbin by a rotary driving unit after setting a coil bobbin; and an adjusting step, by an adjustment driving unit, of adjusting a position of at least the supply reel or coil bobbin in a rotational axis direction of the supply reel in such a way that a position of a wrapping point of the coil bobbin around which the superconducting wire being supplied from the supply reel is wrapped becomes equal to a position of the supply reel in an axis direction of the supply reel.

According to the present invention, there is provided a superconducting coil production method for producing a non-coplanar three-dimensional superconducting coil by winding a tape-like superconducting wire, comprising: a rotating step of rotating the coil bobbin by a rotary driving unit after setting a coil bobbin; and an adjusting step, by an adjustment driving unit, of adjusting a tilt of the coil bobbin with respect to a coil axis of the superconducting coil in such a way that a position of a wrapping point of the coil bobbin around which the superconducting wire being supplied from the supply reel is wrapped becomes equal to a position of the supply reel in an axis direction of the supply reel.

Advantage of the Invention

According to the present invention, it is possible to wind a tape-like superconducting wire on a three-dimensional coil as well as to prevent a decrease in the superconducting properties.

DETAILED DESCRIPTION OF EMBODIMENTS

Hereinafter, with reference to the accompanying drawings, embodiments of a superconducting coil production apparatus and a superconducting coil production method of the present invention will be described. The same or similar portions are represented by the same reference symbols, and a duplicate description will be omitted.

First Embodiment

Figure 1:
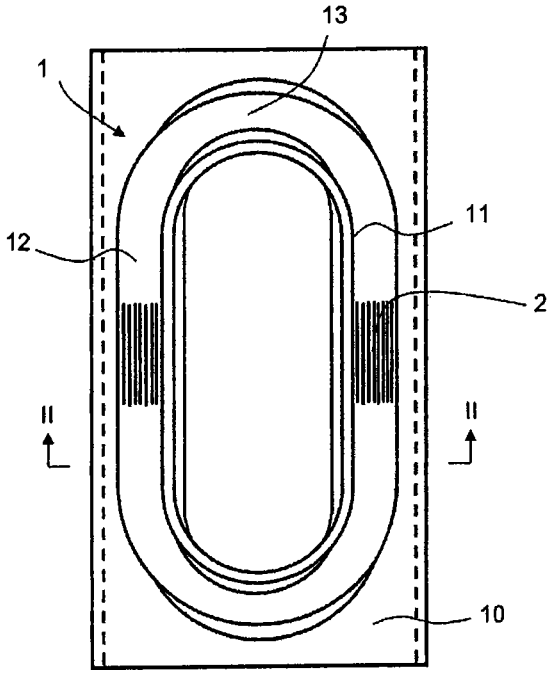
FIG. 1 is a top view of a superconducting coil produced by a superconducting coil production method according to a first embodiment.
Figure 2:
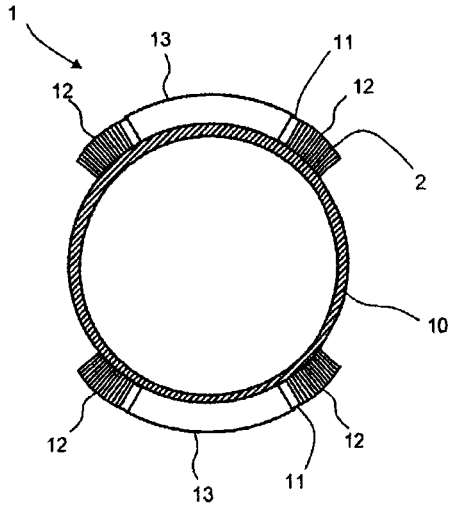
FIG. 2 is a cross-sectional view of the superconducting coil produced by the superconducting coil production method of the first embodiment of FIG. 1 taken along arrows II-II.

FIG. 1 is a top view of a superconducting coil produced by a superconducting coil production method according to a first embodiment. FIG. 2 is a cross-sectional view of a superconducting coil produced by a superconducting coil production method of the first embodiment taken along arrows II-II.

A superconducting coil 1 is produced by winding a tape-like superconducting wire 2 around a coil bobbin 11, which is fixed onto a cylindrical base 10. In the superconducting coil 1, linear portions 12 and end portions 13 are formed.

The two linear portions 12 extend along a longitudinal direction of the coil bobbin 11 in such a way as to be parallel to each other. The two end portions 13 each extend along a circumferential direction of the coil bobbin 11, and connect one-side ends of the linear portions 12 together, and connect the other-side ends of the linear portions 12 together.

The superconducting wire 2 has a tape shape. Therefore, the superconducting wire 2 has edge portions at both width-direction ends. Portions of the coil bobbin 11 that are dedicated to the linear portions 12 are inclined in a direction in which a far-side edge portion from the base 10 with respect to a coil axis is more separated from the coil axis. That is, the portions of the coil bobbin 11 in the two linear portions 12 are inclined in the direction in which the far-side edge portions from the base 10 draw more apart from each other.

Meanwhile, the portions of the coil bobbin 11 that are dedicated to the two end portions 13 are inclined in a direction in which far-side edge portions from the base 10 approach each other.

In this manner, the tilt of the coil bobbin 11 in the linear portions 12 and the tilt of the coil bobbin 11 in the end portions 13 are formed in opposite directions. Therefore, the length of the tape-like superconducting wire 2 that is wound around the coil bobbin 11 is almost equal in the two edge portions. As a result, the distortion in the edgewise direction of the tape-like superconducting wire 2 is suppressed.

Moreover, the tape-like superconducting wire 2 that is wound around the coil bobbin 11 is stacked along the base 10 toward the upper surface of the superconducting wire 2 that has already been wound, or toward a radial-direction outer side when seen from the coil axis.

Figure 3:
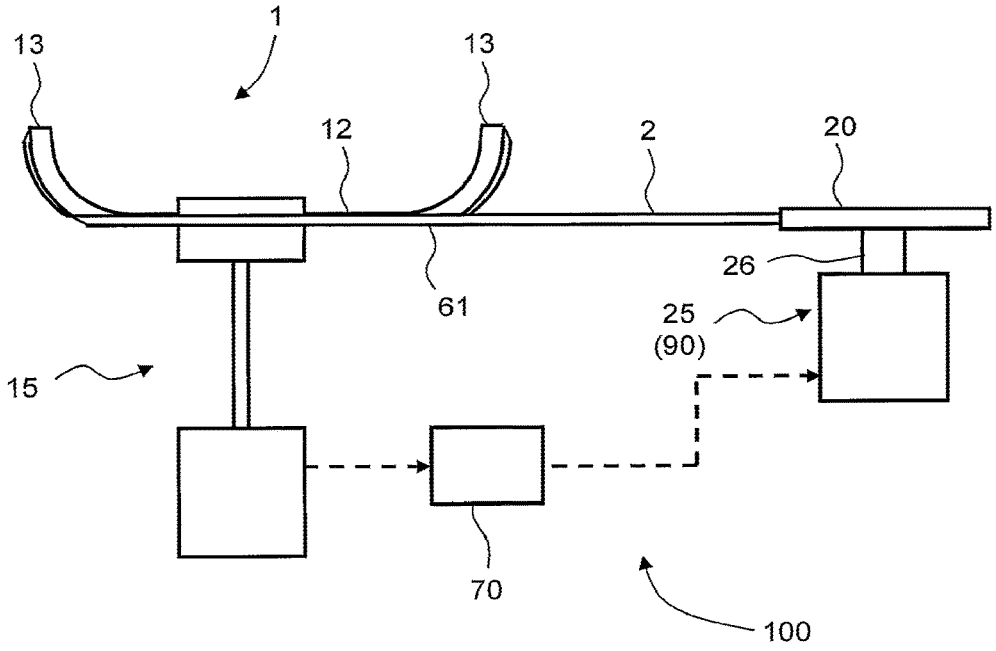
FIG. 3 is a front view showing the configuration of the superconducting coil production apparatus of the first embodiment and a first state of winding by the superconducting coil production method.
Figure 4:
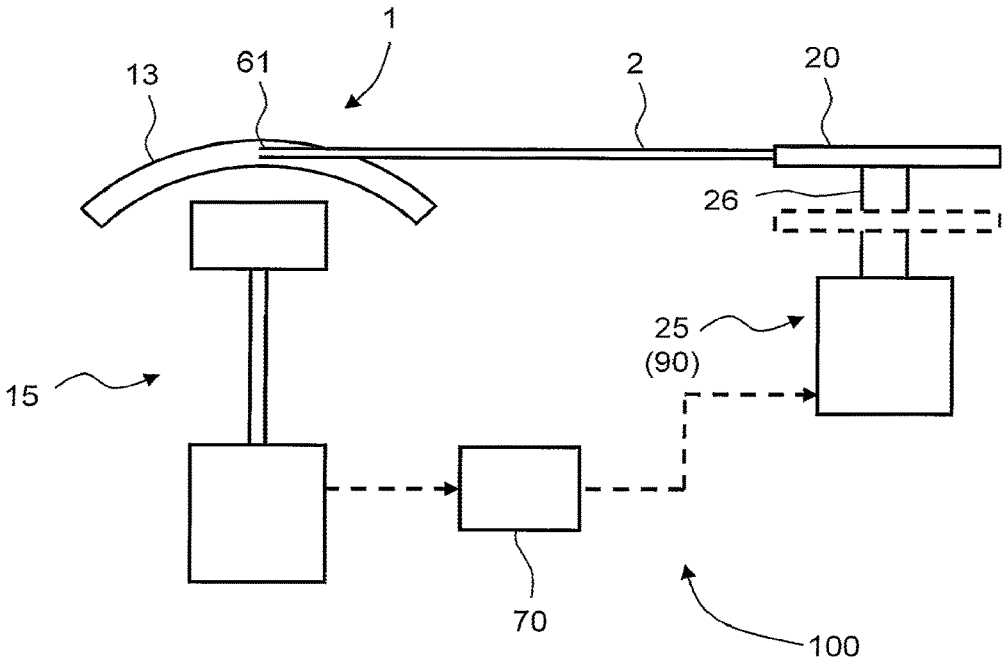
FIG. 4 is a front view showing the configuration of the superconducting coil production apparatus of the first embodiment and a second state of winding by the superconducting coil production method.

FIG. 3 is a front view showing the configuration of a superconducting coil production apparatus of the first embodiment and a first state of winding by a superconducting coil production method. FIG. 4 is a front view showing the configuration of a superconducting coil production apparatus of the first embodiment and a second state of winding by a superconducting coil production method.

A superconducting coil production apparatus 100 includes the coil bobbin 11 (Refer to FIGS. 1 and 2), a rotary driving unit 15, a supply reel 20, a axis direction driving unit 25, and a synchronization control unit 70. FIGS. 3 and 4 are simplified in order to particularly show the relation between the superconducting coil 1 that is being wound and the superconducting wire 2 that is being supplied from the supply reel 20; the base 10 and the coil bobbin 11 are therefore not shown in the diagrams.

The rotary driving unit 15 rotates and drives the coil bobbin 11 around the coil axis of the superconducting coil 1. More specifically, the rotary driving unit 15 supports the base 10; the rotary driving unit 15 directly rotates and drives the base 10. As the base 10 rotates, the coil bobbin 11 that is situated on the base 10 and the coiled superconducting wire 2 wound around the coil bobbin 11 rotate.

The supply reel 20 is a supply source of the superconducting wire 2 to the coil bobbin 11. On the supply reel 20, the tape-like superconducting wire 2 is wound in a pancake-winding coil pattern. The supply reel 20 is provided in such a way that a rotation axis thereof is parallel to the coil axis of the superconducting coil 1.

The axis direction driving unit 25 supports the supply reel 20 via an axis direction drive shaft 26. The axis direction driving unit 25 is synchronously controlled in accordance with a rotational-direction phase of the base 10 by the rotary driving unit 15, and the axis direction driving unit 25 drives and swings the supply reel 20 in a rotational axis direction in such a way as to adjust the rotational-axis-direction position of the supply reel 20.

The synchronous control is performed by the synchronization control unit 70, which calculates, based on the rotation phase of the rotary driving unit 15, the position where the supply reel 20 is supposed to take and which then outputs the position to the axis direction driving unit 25. The position of the supply reel 20 with respect to the rotation phase of the rotary driving unit 15 may be calculated in advance, and the result may be output to the axis direction driving unit 25.

More specifically, the axis direction driving unit 25 adjusts the position of the supply reel 20 relative to a wrapping point 61 of the coil bobbin 11 around which the superconducting wire 2 being supplied from the supply reel 20 is wrapped in such a way that the position of the wrapping point 61 relative to an axis direction of the supply reel 20 is the same as the position of the supply reel 20 relative to the axis direction.

In this case, the wrapping point 61 is a point where a superconducting wire 2 which extends linearly and is about to be wound is in contact with an outer surface of a superconducting wire 2 that is already wound around the coil bobbin 11.

FIG. 3 shows the positional relation between the superconducting coil 1 and the supply reel 20 when the wrapping point 61 is in the linear portion 12. In this state, the supply reel 20 is located at the lowest position in the diagram.

FIG. 4 shows the positional relation between the superconducting coil 1 and the supply reel 20 when the wrapping point 61 is at the center of the end portion 13. In this state, the supply reel 20 is located at the highest position in the diagram. Accordingly, the axis direction drive shaft 26 is longer in the upward direction, compared with the state of FIG. 3.

When the winding is carried out, it is desirable that a constant level of tension be given to the wire from a tension mechanism, and that the winding be carried out with a uniform tightening force. As for the tension mechanism, a typical system may be used as described below.

Figure 5:
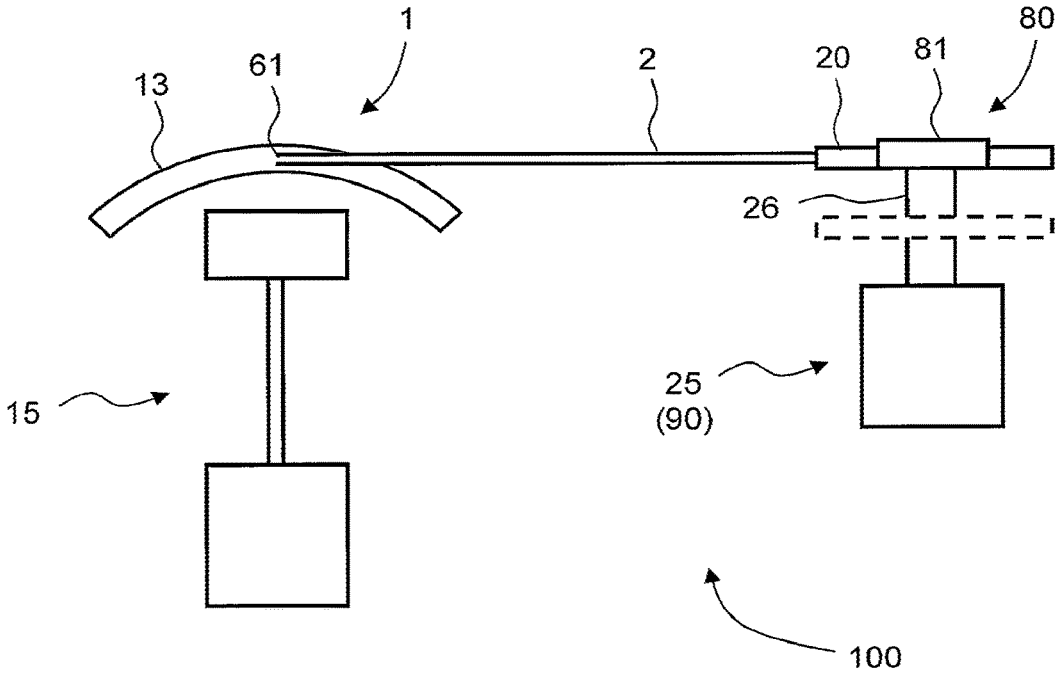
FIG. 5 is a front view for explaining the configuration of the superconducting coil production apparatus of the first embodiment and a tension mechanism used by the superconducting coil production method.

FIG. 5 is a front view for explaining the configuration of a superconducting coil production apparatus of the first embodiment and a tension mechanism used by a superconducting coil production method. A tension mechanism 80 includes a torque control mechanism 81. Moreover, the axis direction driving unit 25 of the supply reel 20 also rotates and drives the supply reel 20. The torque control mechanism 81 is mounted on the axis direction drive shaft 26 of the supply reel 20. The torque control mechanism 81, which includes such portions as one that conveys slip torque via a powder clutch or a friction plate, rotates the portions in a direction in which the superconducting wire 2 is fed and in the opposite direction by using the axis direction driving unit 25. In this manner, the torque control mechanism 81 can give tension to the superconducting wire 2.

Figure 6:
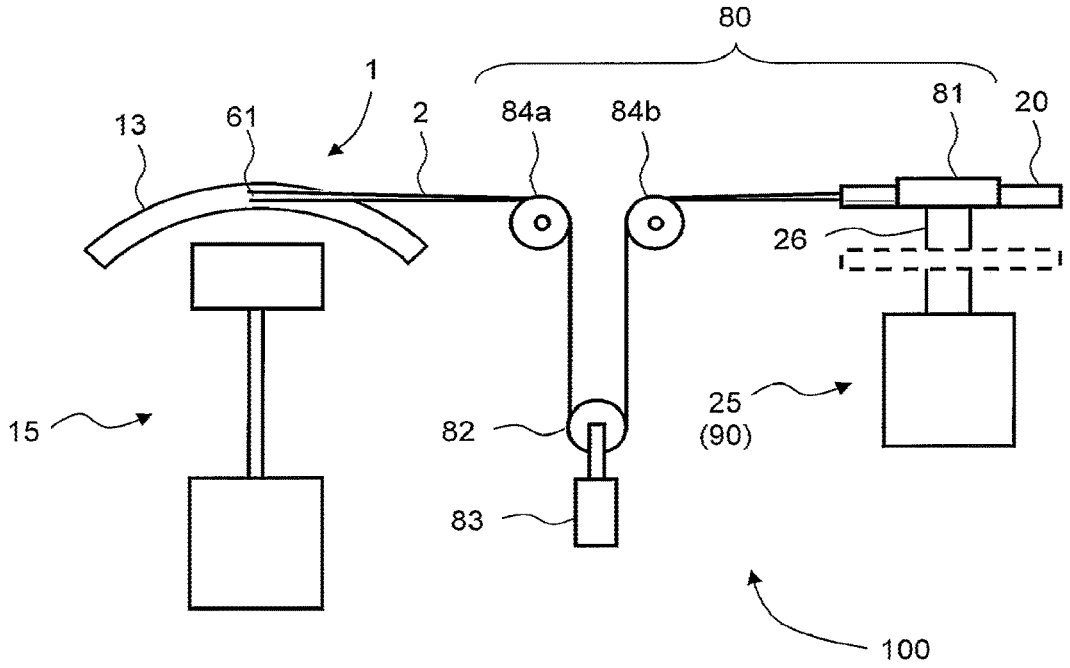
FIG. 6 is a front view for explaining the configuration of the superconducting coil production apparatus of the first embodiment and a modified example of a tension mechanism used by the superconducting coil production method.

FIG. 6 is a front view for explaining the configuration of a superconducting coil production device of the first embodiment and a modified example of a tension mechanism used in a superconducting coil production method. In this case, a tension mechanism 80 includes a torque control mechanism 81, a movable pulley 82, a weight 83, a fixed pulley 84*a*, and a fixed pulley 84*b*. The movable pulley 82, the weight 83, the fixed pulley 84*a*, and the fixed pulley 84*b* are placed between the supply reel 20 and the wrapping point 61. The movable pulley 82 from which the weight 83 is suspended is suspended between the fixed pulley 84*a* and the fixed pulley 84*b*. The rotation speed of the supply reel 20 is controlled in such a way as to keep the weight 83 at a constant height. As a result, the tension being applied to the superconducting wire 2 is substantially kept constant.

Figure 7:
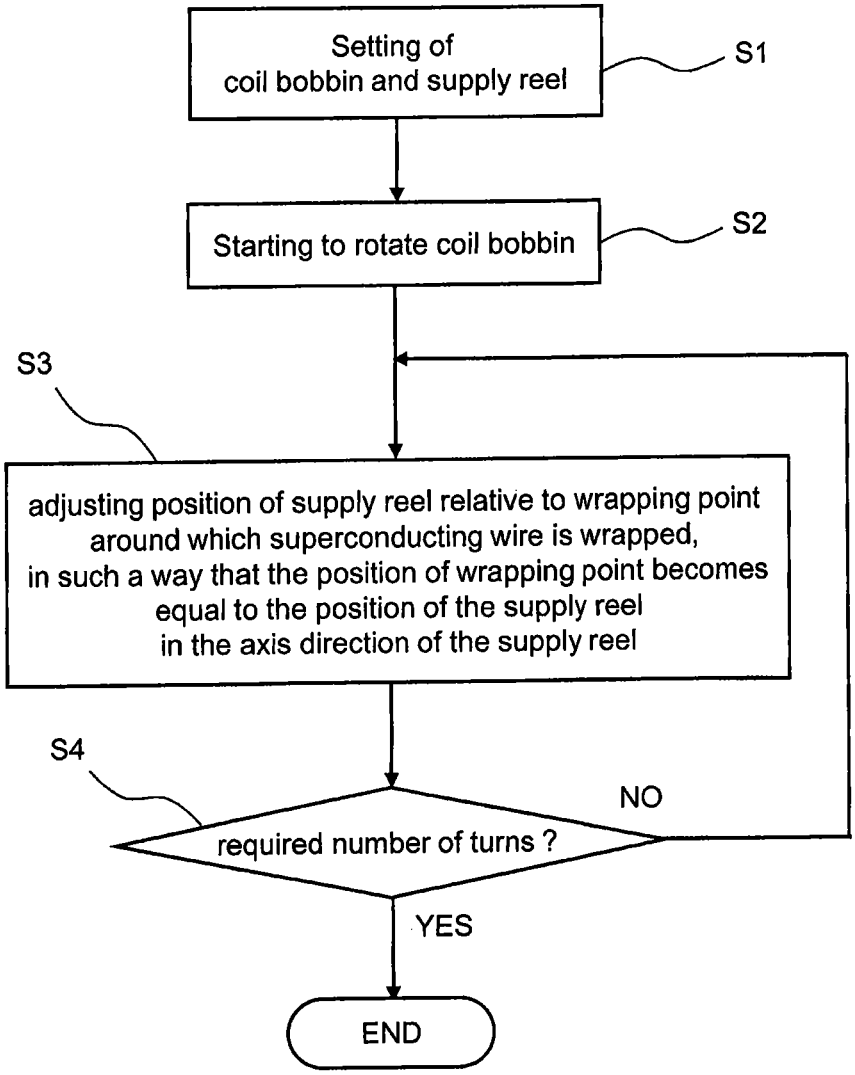
FIG. 7 is a flowchart showing a procedure of the superconducting coil production method of the first embodiment.

FIG. 7 is a flowchart showing a procedure of a superconducting coil production method of the first embodiment.

First, the settings of the coil bobbin 11, rotary driving unit 15, supply reel 20, and axis direction driving unit 25 are done (Step 1).

After step S1, the rotary driving unit 15 starts to rotate the coil bobbin 11 (Step S2).

At a time when the coil bobbin 11 is rotating, the axis direction driving unit 25 adjusts the position of the supply reel 20 relative to the wrapping point 61 around which the superconducting wire 2 is wrapped, in such a way that the position of the wrapping point 61 becomes equal to the position of the supply reel 20 in the axis direction of the supply reel 20 (Step S3).

A determination is made as to whether or not a required number of turns on the coil bobbin 11 has been secured. If it is determined that the number of turns has been secured, the winding comes to an end (Step S4).

As for position of the wrapping point 61 is at the linear portions 12 or at the end portions 13 of the superconducting coil 1 shown in FIGS. 3 and 4, the positions of the drive shaft direction of the axis direction driving unit 25 are different. Accordingly, when the superconducting coil 1 is rotated by the rotary driving unit 15, the wrapping point 61 where the superconducting wire 2 is wound along the outer shape of the superconducting coil 1 is changed in height.

If the supply reel 20 is at a constant height, the difference in height between the supply reel 20 and the wrapping point 61 would occur. However, according to the present embodiment, the axis direction driving unit 25 is synchronously controlled in accordance with the rotational-direction phase of the rotary driving unit 15. Therefore, the situation where the difference in height does not occur continues.

The portion that drives in such a way as not to cause a difference between the position of the wrapping point 61 and that of the supply reel 20 in the rotational axis direction of the supply reel 20 as described above is referred to as an adjustment driving unit 90. In the case of the present embodiment, the axis direction driving unit 25 serves as the adjustment driving unit.

As described above, according to the present embodiment, it is possible to reduce the edgewise distortion applied to the superconducting wire 2 as much as possible when the wire is being wound. Therefore, it is possible to reduce the risk of a deterioration in the superconducting properties of the superconducting wire 2 associated with the edgewise distortion.

According to the present embodiment, the supply reel 20 is moved up and down by the axis direction driving unit 25. However, the present invention is not limited to this. For example, the supply reel 20 may be kept at a constant height, and the rotary driving unit 15 may be driven up and down, i.e. the axis direction driving unit of the rotary driving unit 15 may be provided as an adjustment driving unit 90.

Second Embodiment

Figure 8:
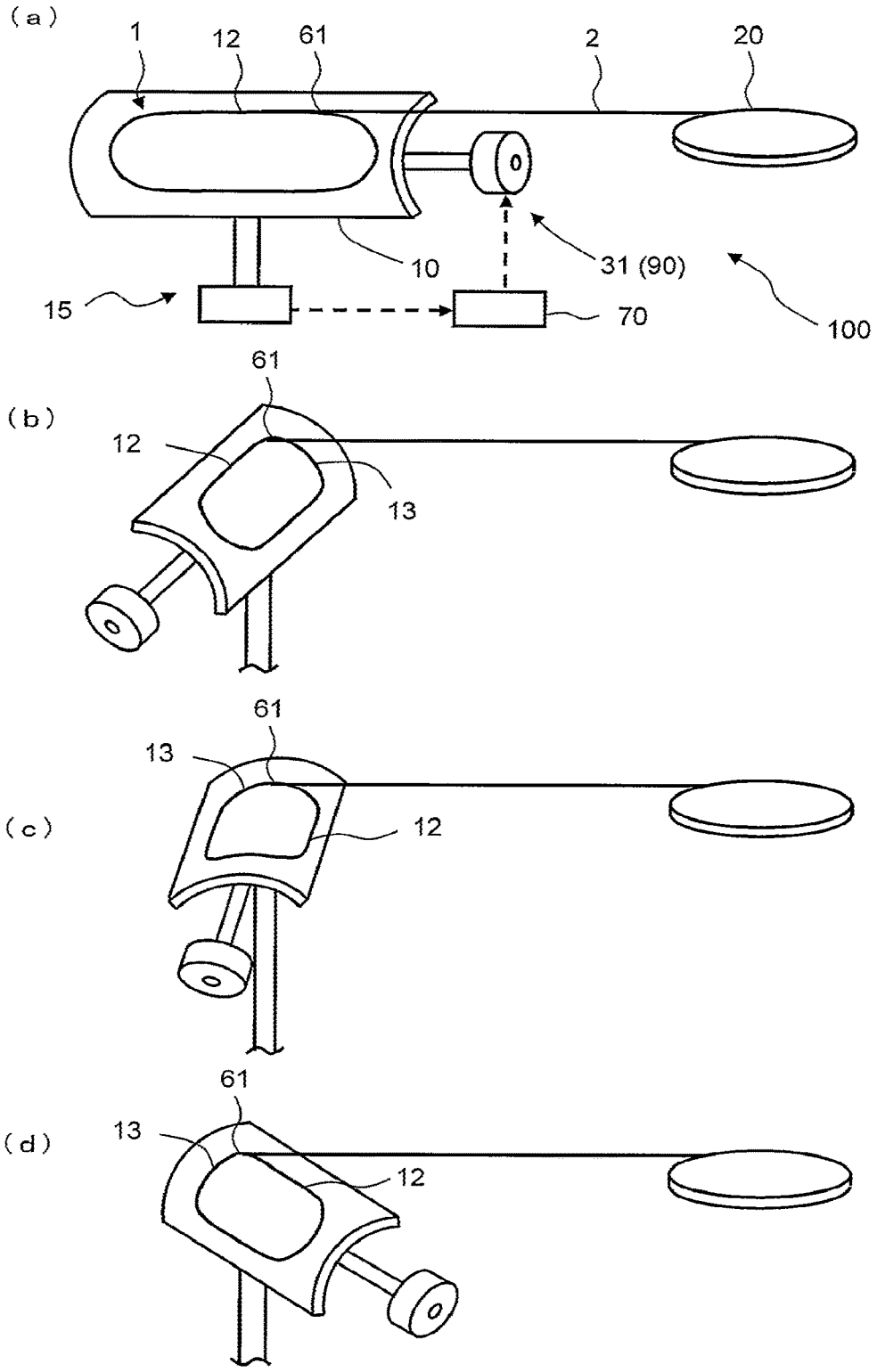
FIG. 8 is a perspective view of the superconducting coil production apparatus and the superconducting coil production method of a second embodiment, and FIGS. 8 (*a*), 8 (*b*), 8 (*c*), and 8 (*d*) show the state of each steps.

FIG. 8 (*a*) to FIG. 8 (*d*) are perspective views showing the configuration of a superconducting coil production apparatus of a second embodiment as well as the state of each step of winding by a superconducting coil production method.

The present embodiment is a variant of the first embodiment. In a superconducting coil production apparatus 100 of the present embodiment, the axis direction driving unit 25, which is provided as an adjustment driving unit in the first embodiment, is not provided. Instead, a base swing driving unit 31 is provided as an adjustment driving unit 90 in the case of the second embodiment.

Although the details are not shown in the diagram, the base swing driving unit 31 is supported by the rotary driving unit 15. The base swing driving unit 31 is rotated and driven by the rotary driving unit 15.

Although the details are not shown in the diagram, the base swing driving unit 31 supports a base 10.

The base swing driving unit 31 is synchronously controlled in accordance with a rotational-direction phase by the rotary driving unit 15, thereby swinging and driving the base 10.

The synchronous control is performed by a synchronization control unit 70, which calculates a tilt angle of the base 10 based on the rotation phase of the rotary driving unit 15, and outputs the tilt angle to the base swing driving unit 31. The tilt angle of the base 10 with respect to the rotation phase of the rotary driving unit 15 may be calculated in advance, and the result may be output to the base swing driving unit 31.

FIG. 8 (*b*), FIG. 8 (*c*), and FIG. 8 (*d*) do not show the synchronization control unit 70.

More specifically, the base swing driving unit 31 adjusts the tilt of the base 10 with respect to the axis direction of the rotary driving unit 15 in such a way that the position of a wrapping point 61 with respect to the axis direction of the rotary driving unit 15 becomes equal to the position of a supply reel 20 with respect to the axis direction.

That is, if the plane is pictured, that is perpendicular to the axis direction of the supply reel 20 and contains the supply reel 20, the tilt of the base 10 is adjusted in a circumferential direction that is perpendicular to the axis direction of the base 10 in such a way that the wrapping point 61 comes into that plane.

While making one revolution around the base 10, in order to make sure that the wrapping point 61 comes into that plane by tilting the base 10 at every circling angle, dimensional conditions need to be satisfied.

Suppose that a minimum value of the distance between the coil bobbin 11 (FIGS. 1 and 2) and the rotational axis center of the rotary driving unit 15 is L; that a difference between the height of the coil bobbin 11, or the linear portion 12, and the height of the coil axis direction of the end portion 13 is H; and that a maximum angle at which the base 10 can be tilted is θ.

At this time, between L, H, and θ, a formula $L \cdot \sin\theta > H$ needs to be satisfied.

From this aspect, it is desirable that the rotation axis of the rotary driving unit 15 be as close as possible to the center of the coil bobbin 11 that is in a direction perpendicular to the axis direction of the supply reel 20.

In FIG. 8, the rotary driving unit 15 rotates the base 10 in a counterclockwise direction. The rotation direction may be clockwise.

FIG. 8 (*a*) shows the case where the wrapping point 61 is in the linear portion 12. FIG. 8 (*b*) shows the case where the wrapping point 61 is in a portion in which the wrapping point 61 is moving from the linear portion 12 to the end portion 13. FIG. 8 (*c*) shows the case where the wrapping point 61 is in the end portion 13. FIG. 8 (*d*) shows the case where the wrapping point 61 is in a portion in which the wrapping point 61 is moving from the end portion 13 to the linear portion 12.

As described above, according to the present embodiment, the base swing driving unit 31 is synchronously controlled in accordance with the rotational-direction phase of the rotary driving unit 15. Therefore, the situation is maintained, where there is no difference between the positions of the wrapping point 61 and supply reel 20 in the rotational-axis direction of the supply reel 20.

As described above, according to the present embodiment, it is possible to reduce as much edgewise distortion applied to the superconducting wire 2 as possible when the wire is being wound. Therefore, it is possible to reduce the risk of a deterioration in the superconducting properties of the superconducting wire associated with the edgewise distortion.

Third Embodiment

Figure 9:
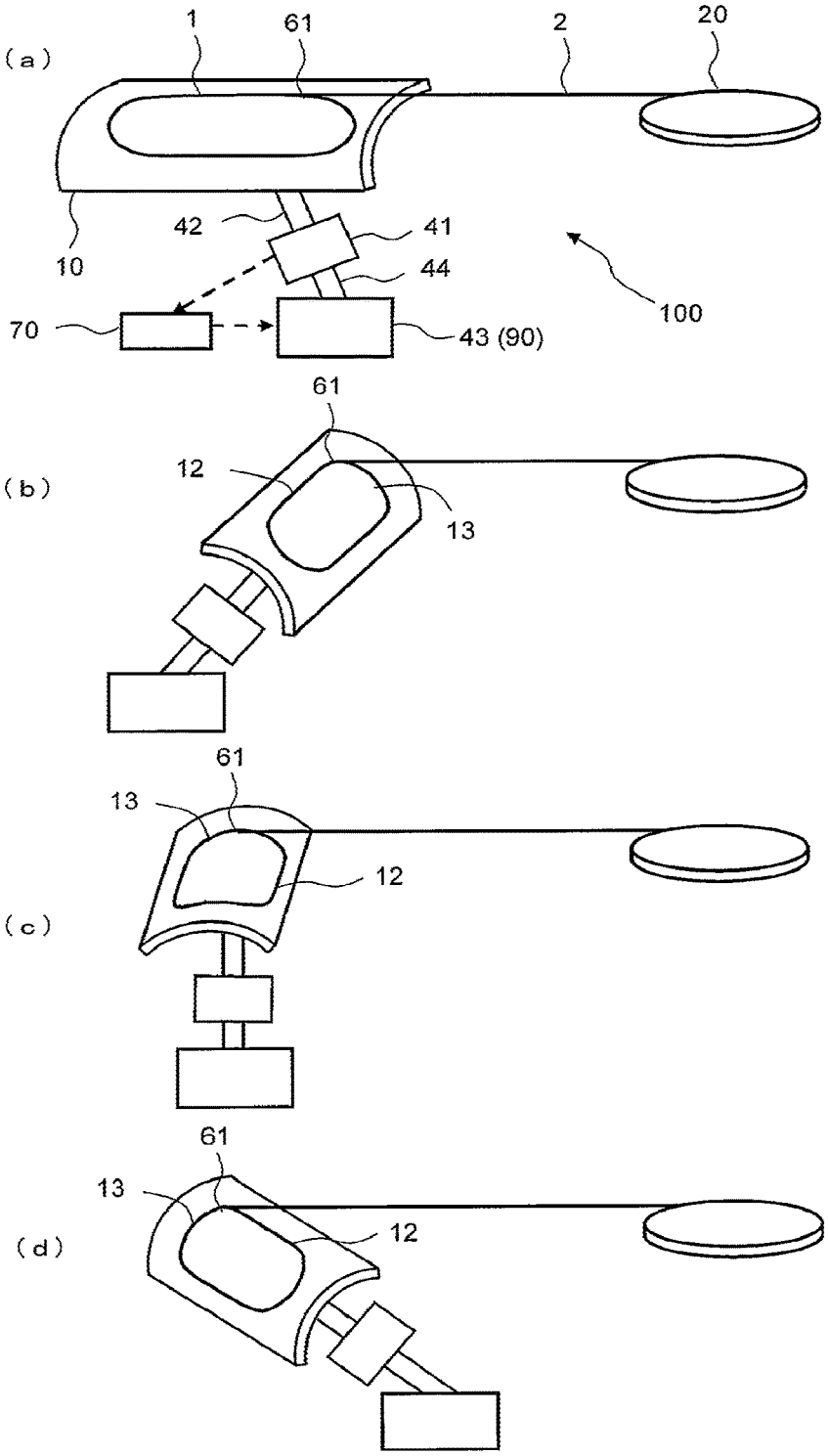
FIG. 9 is a perspective view of the superconducting coil production apparatus and the superconducting coil production method of a third embodiment, and FIGS. 9 (*a*), 9 (*b*), 9 (*c*), and 9 (*d*) show the state of each steps.

FIG. 9 is perspective views showing the configuration of a superconducting coil production apparatus of a third embodiment as well as the state of each step of winding by a superconducting coil production method.

FIG. 9 (*a*) shows the case where the wrapping point 61 is in the linear portion 12. FIG. 9 (*b*) shows the case where the wrapping point 61 is in a portion in which the wrapping point 61 is moving from the linear portion 12 to the end portion 13. FIG. 9 (*c*) shows the case where the wrapping point 61 is in the end portion 13. FIG. 9 (*d*) shows the case where the wrapping point 61 is in a portion in which the wrapping point 61 is moving from the end portion 13 to the linear portion 12.

The present embodiment is a variant of the second embodiment. In the case of the present embodiment, the base swing driving unit 31, which is provided as an adjustment driving unit 90 in the second embodiment, is not provided. Instead, an axis swing driving unit 43 is provided as an adjustment driving unit 90 in the case of the third embodiment.

The axis swing driving unit 43 supports a rotary driving unit 41 via a support shaft 44. The rotary driving unit 41 supports a base 10 via a rotation shaft 42, and rotates and drives the base 10.

The axis swing driving unit 43 changes the tilt of the support shaft 44 in synchronization with the rotary driving unit 41 in such a way that the position of the wrapping point 61 with respect to the axis direction of a supply reel 20 becomes equal to the position of the supply reel 20 with respect to the axis direction. In this manner, the tilt of the base 10 is changed.

The synchronous control is performed by a synchronization control unit 70, which calculates, based on the rotation phase of the rotary driving unit 41, a tilt angle of the support shaft 44 and which then outputs the tilt angle to the axis swing driving unit 43. The tilt angle of the support shaft 44 with respect to the rotation phase of the rotary driving unit 41 may be calculated in advance, and the result may be output to the axis swing driving unit 43.

FIG. 9 (*b*), FIG. 9 (*c*), and FIG. 9 (*d*) do not show the synchronization control unit 70.

As described above, according to the present embodiment, the axis swing driving unit 43 is synchronously controlled in accordance with the rotational-direction phase of the rotary driving unit 41. Therefore, the situation is maintained, where there is no difference between the positions of the wrapping point 61 and supply reel 20 in the rotational-axis direction of the supply reel 20.

As described above, according to the present embodiment, it is possible to reduce as much edgewise distortion applied to the superconducting wire 2 as possible when the wire is being wound. Therefore, it is possible to reduce the risk of a deterioration in the superconducting properties of the superconducting wire 2 associated with the edgewise distortion.

Fourth Embodiment

Figure 10:
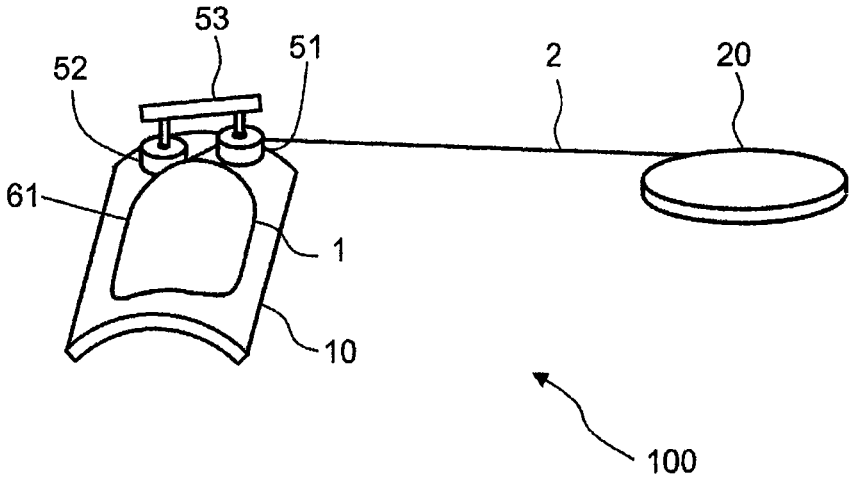
FIG. 10 is a perspective view showing the configuration of the superconducting coil production apparatus of a fourth embodiment as well as the state by the superconducting coil production method.
Figure 11:
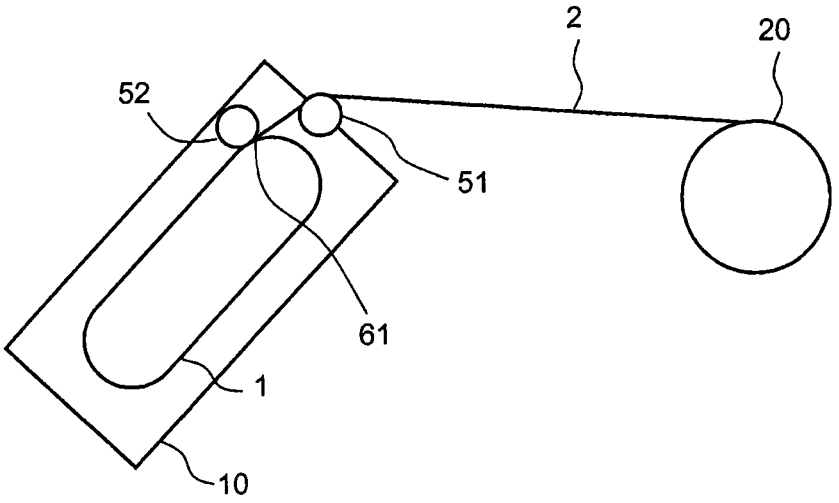
FIG. 11 is a plan view showing relative positional relation between a guide of the superconducting coil production apparatus of the fourth embodiment, a holding head, and a supply reel.

FIG. 10 is a perspective view showing the configuration of a superconducting coil production apparatus of a fourth embodiment as well as the state by a superconducting coil production method. FIG. 11 is a plan view showing relative positional relation between a guide of a superconducting coil production apparatus, a holding head, and a supply reel of the fourth embodiment.

The present embodiment is a variant of the second embodiment. A superconducting coil production apparatus 100 of the present embodiment further includes a guide 51 and a holding head 52.

The holding head 52 is cylindrical in shape, and is designed to hold a superconducting coil 1 by a side surface thereof at a wrapping point 61.

The guide 51 is cylindrical in shape. On a side surface of the guide 51, a concave portion is formed in such a way as to allow the superconducting wire 2 to slide along the side surface of the guide 51. The guide 51 is so formed to be rotatable around a cylindrical shaft so that the guide 51 does not block the sliding of the superconducting wire 2.

The superconducting wire 2 is supplied from a supply reel 20 and slides on the side surface of the guide 51 before being drawn into between the superconducting coil 1 and the holding head 52.

As shown in FIG. 11, the superconducting wire 2 does not linearly move from the supply reel 20 to a wrapping point 61; the guide 51 is disposed in such a way that the superconducting wire 2 reaches the wrapping point 61 after changing its direction at the holding head 52. Accordingly, the guide 51 is supported by an external portion independently of the base 10.

The guide 51 adjusts and drives the position of the holding head 52 via a support portion 53 in such a way that the holding head 52 positions the superconducting wire 2 at the wrapping point 61.

The configuration of the guide 51 is not limited to the one described above. For example, the guide 51 may be configured in such a way as to be freely rotatable and to have a slit formed thereon, with the superconducting wire 2 capable of sliding in the slit.

In cases where the wire is being wound to make the superconducting coil 1, only the holding head 52 may be provided with no guide 51. In such a case, the relative positional relation between the wrapping point 61, supply reel 20, and holding head 52 would change in every phase of the rotating superconducting coil 1.

Accordingly, if there is only the holding head 52 with no guide 51, the interaction of force between the superconducting wire 2 at the wrapping point 61 and the holding head 52 would change. The use of only the holding head 52 makes it impossible to position the superconducting wire 2 as designed in terms of coil shape, thereby causing an irregular winding.

According to the present embodiment, the guide 51 is located between the supply reel 20 and the holding head 52, and works to keep the positional relation between the superconducting wire 2 and the holding head 52.

In that manner, according to the present embodiment, it is possible to further suppress an irregular winding of wire, and more accurately wind the wire to make a superconducting coil.

Other Embodiments

For example, what has been described in the embodiments is the case where only the superconducting wire 2 is supplied from the supply reel 20. However, the present invention is not limited to this.

For example, the superconducting wire 2 may be wound just around the coil bobbin 11; or the superconducting wire 2 may be wound together with an insulation tape, which ensures electrical insulation between turns. Like a curved coil used in a deflection magnet for an accelerator, in order to maintain a coil shape which has a concave portion on an inner side of the outline of the superconducting coil 1, turns may be bonded together with an adhesive at the wrapping point 61; or the wire may be wound together with a two-sided adhesive tape to fix the turns.

In the embodiments, the vertical direction is used in the description. However, this is intended to make the description easier, and the present invention is not limited to this. The structure may be overturned or tilted.

Features of each of the embodiments may be used in combination. For example, the adjusting by the axis direction driving unit 25, which is an adjustment driving unit of the first embodiment, and the adjusting by the base swing driving unit 31, which is an adjustment driving unit 90 of the second embodiment, may be used in combination.

Alternatively, the adjusting by the axis direction driving unit 25, which is an adjustment driving unit of the first embodiment, and the adjusting by the axis swing driving unit 43, which is an adjustment driving unit 90 of the third embodiment, may be used in combination.

Moreover, the configuration that includes the supply reel 20 and holding head 52 of the fourth embodiment may be used in combination with the second or third embodiment.

The embodiments may be embodied in other various forms. Various omissions, replacements and changes may be made without departing from the subject-matter of the invention.

The above embodiments and variants thereof are within the scope and subject-matter of the invention, and are similarly within the scope of the invention defined in the appended claims and the range of equivalency thereof.

EXPLANATION OF REFERENCE SYMBOLS

1: superconducting coil, 2: superconducting wire, 10: cylindrical base, 11: coil bobbin, 12: linear portions, 13: end portions, 15: rotary driving unit, 20: supply reel, 25: axis direction driving unit (adjustment driving unit), 26: axis direction drive shaft, 31: base swing driving unit (adjustment driving unit), 41: rotary driving unit, 42: rotation shaft, 43: axis swing driving unit (adjustment driving unit), 44: support shaft, 51: guide, 52: holding head, 53: support portion, 61: wrapping point, 70 synchronization control unit, 80: tension mechanism, 81: torque control mechanism, 82: movable pulley, 83: weight, 84: fixed pulley, 84*a*: fixed pulley, 84*b*: fixed pulley, 90: adjustment driving unit, 100: superconducting coil production apparatus

The invention claimed is:

1. A superconducting coil production apparatus that produces a non-coplanar three-dimensional superconducting coil by winding a tape-shaped superconducting wire, the apparatus comprising:

a coil bobbin around which the superconducting wire is wound;

a rotary driving unit to rotate the coil bobbin around a coil axis of the superconducting coil;

a supply reel to supply the superconducting wire to the coil bobbin; and an adjustment driving unit to adjust a position of the supply reel relative to a wrapping point so that a position of the wrapping point of the coil bobbin around which the superconducting wire being supplied from the supply reel is wrapped is kept the same position as the position of the supply reel in a rotational axis direction of the supply reel.

2. The superconducting coil production apparatus according to claim 1, wherein the superconducting coil is made by stacking the tape-shaped superconducting wire in a thickness direction.

3. The superconducting coil production apparatus according to claim 1, wherein:

the supply reel is provided in such a way that a rotation axis thereof is parallel to the coil axis of the superconducting coil; and the adjustment driving unit makes an adjustment by driving a position of at least the supply reel or coil bobbin in the rotational axis direction of the supply reel.

4. The superconducting coil production apparatus according to claim 1, wherein the adjustment driving unit adjusts a tilt of the coil bobbin relative to the coil axis of the superconducting coil.

5. The superconducting coil production apparatus according to claim 4, wherein the adjustment driving unit includes a swing driving unit supported by the rotary driving unit and the adjustment driving unit to swing while supporting the coil bobbin, in order to adjust the tilt.

6. The superconducting coil production apparatus according to claim 1, wherein the adjustment driving unit adjusts a tilt of the rotary driving unit relative to the coil axis of the superconducting coil.

7. The superconducting coil production apparatus according to claim 1, further comprising a synchronization control unit that controls the adjustment driving unit in such a way that the adjustment driving unit operates in synchronization with a rotation phase of the rotary driving unit.

8. The superconducting coil production apparatus according to claim 1, further comprising:

a holding head to position the superconducting wire at the wrapping point; and a guide provided between the supply reel and the holding head to control a position of the superconducting wire in order to keep positional relation between the holding head and the wire and an interaction state of force.

9. The superconducting coil production apparatus according to claim 1, further comprising a tension mechanism that gives tension in a longitudinal direction of the superconducting wire.

10. A superconducting coil production method for producing a non-coplanar three-dimensional superconducting coil by winding a tape-shaped superconducting wire, comprising:

a rotating step of rotating a coil bobbin by a rotary driving unit after setting the coil bobbin; and an adjusting step, by an adjustment driving unit, of adjusting a position of at least a supply reel or coil bobbin in an axis direction of the supply reel in such a way that a position of a wrapping point of the coil bobbin around which the superconducting wire being supplied from the supply reel is wrapped becomes equal to a position of the supply reel in the axis direction of the supply reel.

11. A superconducting coil production method for producing a non-coplanar three-dimensional superconducting coil by winding a tape-shaped superconducting wire, comprising:

a rotating step of rotating a coil bobbin by a rotary driving unit after setting the coil bobbin; and an adjusting step, by an adjustment driving unit, of adjusting a tilt of the coil bobbin with respect to a coil axis of the superconducting coil in such a way that a position of a wrapping point of the coil bobbin around which the superconducting wire being supplied from a supply reel is wrapped becomes equal to a position of the supply reel in an axis direction of the supply reel.

* * * * *